US006081958A

United States Patent [19]

Van Staagen

[11] Patent Number: 6,081,958

[45] Date of Patent: Jul. 4, 2000

[54] SCRUB BRUSH HAVING KNUCKLE PROTECTOR

[76] Inventor: Michael Van Staagen, 705 Lincoln Pkwy., Duluth, Minn. 55806

[21] Appl. No.: 09/169,806

[22] Filed: Oct. 9, 1998

[51] Int. Cl.[7] ..... A46B 5/02

[52] U.S. Cl. ..... 15/114; 15/159.1; 15/246; D4/129

[58] Field of Search ..... 15/114, 143.1, 15/159.1, 171, 175, 246; D4/116, 119, 120, 129, 130, 137, 138

[56] References Cited

U.S. PATENT DOCUMENTS

| | | | |
|---|---|---|---|
| 101,307 | 3/1870 | Pearson | 15/143.1 |
| 686,708 | 11/1901 | Braxton | 15/114 |
| 817,117 | 4/1906 | Isaacs | 15/246 |
| 2,215,610 | 9/1940 | Goldrick et al. | 15/175 X |
| 3,802,024 | 4/1974 | Fenster | 15/208 X |
| 5,623,739 | 4/1997 | Thompson | 15/143.1 X |

FOREIGN PATENT DOCUMENTS

| | | | |
|---|---|---|---|
| 812 | of 1880 | United Kingdom | 15/159.1 |
| 4599 | of 1891 | United Kingdom | 15/143.1 |
| 358689 | 10/1931 | United Kingdom | 15/246 |
| 383394 | 11/1932 | United Kingdom | 15/143.1 |

*Primary Examiner*—Mark Spisich
*Attorney, Agent, or Firm*—Coats & Bennet, P.L.L.C.

[57] ABSTRACT

A scrub brush includes a bristle block having an array of bristles depending therefrom. Disposed over the bristle block and spaced therefrom is a handle that is supported by a pair of spaced apart handle supports that extend between the bristle block and the handle. Disposed on the bristle block is a relatively soft foam knuckle protector for engaging the knuckles of the hand of a user while the scrub brush is moved over a cleaning area or when the hand slips with respect to the handle. Also, in one embodiment, the knuckle protector assumes the form of a removable pad that can be used for scrubbing, cleaning or sponging.

10 Claims, 3 Drawing Sheets

SCRUB BRUSH HAVING KNUCKLE PROTECTOR

FIELD OF THE INVENTION

The present invention relates to scrub brushes, and more particularly to a scrub brush having a knuckle protector pad associated therewith.

BACKGROUND OF THE INVENTION

Scrub brushes are used for a wide variety of cleaning chores. Typically such scrub brushes include a bristle block. Depending from the underside of the bristle block is an array of bristles. Formed above the bristle block is a handle that is sometimes supported by a pair of spaced apart handle supports that extend between the bristle block and opposite end portions of the handle.

In using such scrub brushes, one wraps his or her hand around the handle and begins to move the scrub brush over an area to be cleaned. Normally during this cleaning operation, the knuckles and the knuckle area of the hand lay on the underside of the handle and generally face the upper side of the bristle block. Because the bristle block generally lies very close to the handle, it is not all that uncommon for the hand to slightly slip from the handle and this results in the knuckles and the knuckle area of the hand impacting and sliding against the bristle block. This can obviously result in the knuckles of the hand being scraped or cut. The surface being cleaned can even make matters worse. For example, when the scrub brush engages an obstruction or an area that is very difficult to clean, it is possible for the entire scrub brush to cock or twist to one side and that often causes the hand to slip from the handle and results in the knuckles of the hand or the area in and around the knuckles to impact against an adjacent portion of the scrub brush or the bristle block.

Moreover, the force exerted by the scrub brush against the surface being cleaned is generally the result of the force being applied to the handle of the scrub brush through the palm of the user's hand. From an efficiency point of view, the force generated as a result of the palm bearing down on the handle is not always optimum, and in fact this arrangement or approach can lead to hand fatigue, especially on cleaning jobs that are difficult and require hours of scrubbing.

Therefore, there has been and continues to be a need for a scrub brush that protects the knuckles of the hand while the scrub brush is being moved and forced over an area being cleaned.

SUMMARY OF THE INVENTION

The present invention entails a scrub brush that includes a knuckle protector pad that acts to protect the knuckles and the area of the hand around the knuckles during a scrub brush cleaning operation. In one embodiment of the present invention, the scrub brush includes a bristle block having an array of bristles depending from a lower surface thereof. A handle is disposed over the bristle block. Disposed on the upper surface of the bristle block is a relatively soft knuckle pad that is spaced downwardly from the handle and which acts to engage the knuckle portion of the users hand during a cleaning operation. Thus, the knuckle pad lies immediately adjacent the knuckles and finger portions of the user's hand and presents a relatively soft cushion for the knuckles and finger portions to engage during a cleaning operation.

In one particular embodiment of the present invention, the knuckle pad is provided in the form of a knuckle pad insert.

Here the knuckle pad includes a generally soft foam pad that is designed to be readily inserted into and removed from the scrub brush. In this embodiment, the handle is supported by a pair of spaced apart handle supports that extend from opposite end portions of the handle. The insert knuckle pad includes a pair of opposed cutouts or indentions that are designed to extend at least partially around the handle supports. When inserted between the handle supports, the insert knuckle pad is effectively retained within the scrub brush.

It is therefore an object of the present invention to provide an improved ergonomically designed scrub brush that includes a knuckle protector pad for protecting the knuckles and areas of the hand around the knuckles when the scrub brush is being used.

DETAILED DESCRIPTION OF THE INVENTION

Figure 1:
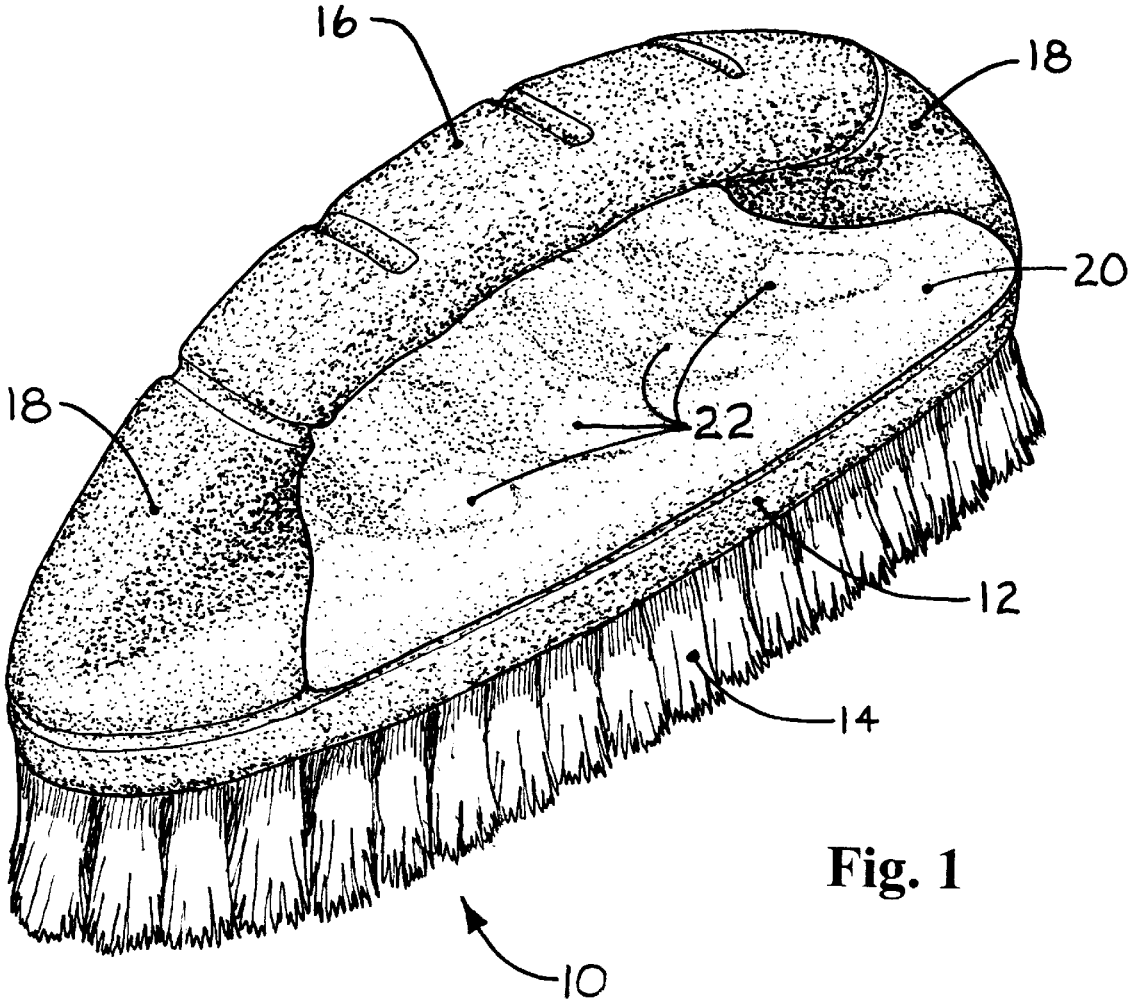
FIG. 1 is a perspective view of the scrub brush of the present invention.
Figure 4:
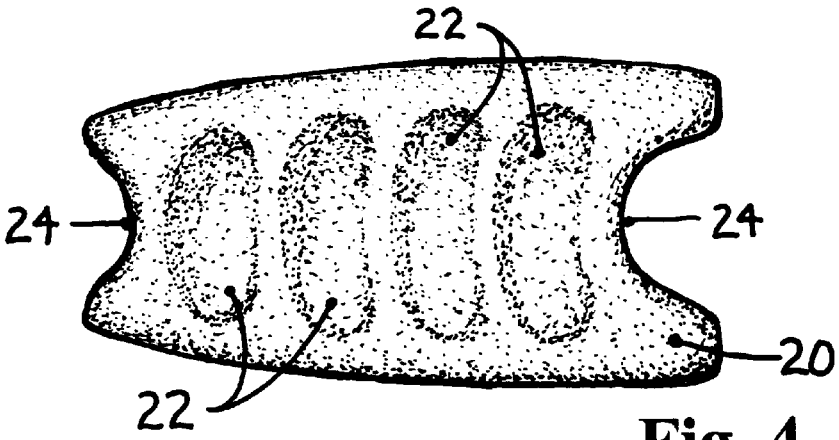
FIG. 4 is a top plan view of the knuckle protector pad.

With further reference to the drawings, the scrub brush of the present invention is shown therein and indicated generally by the numeral 10. Viewing the scrub brush structurally, the same includes a bristle block or base member 12. The bristle block or base member 12 includes upper and lower surfaces. Depending from the lower surface of the bristle block 12 is an array of bristles 14.

Disposed and spaced over the bristle block 12 is a handle 16. The handle 16 is supported at opposed ends by a pair of spaced apart handle supports 18. As shown in the drawings, the handle supports 18 extend upwardly from the upper surface of the bristle block 12 and join the handle 16 at opposed ends thereof. It is appreciated, that the handle 16 and the handle supports 18 could be an integral or molded structure or in the alternative, the handle supports 18 could simply be joined and secured to opposed ends of the handle 16.

Disposed on the upper side of the bristle block 12 is a knuckle pad indicated generally by the numeral 20. The knuckle pad is in the form of a relatively soft foam pad and as seen in the drawings, assumes a position spaced below the handle 16. As noted above, the foam knuckle pad 20 is generally compressible and is described as being relatively soft with respect to, for example, the bristle block 12.

Formed in the upper surface of the knuckle pad 20 is a series of impressions 22. Note in the embodiment illustrated herein, that there are four spaced apart impressions 22 that are generally designed to receive the finger or knuckle portions of a user's hand.

Figure 3:
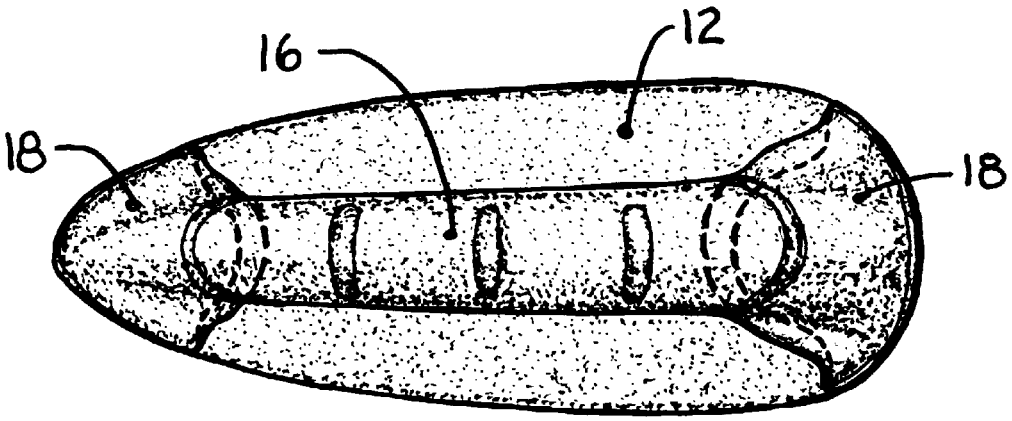
FIG. 3 is a top plan view of the scrub brush with the knuckle pad removed.
Figure 2:
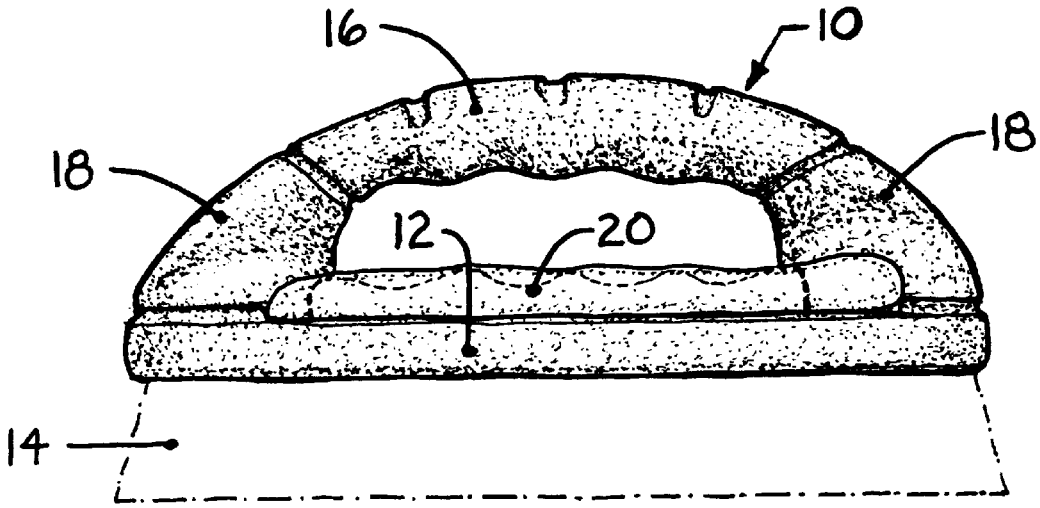
FIG. 2 is a side elevational view of the scrub brush.
Figure 5:
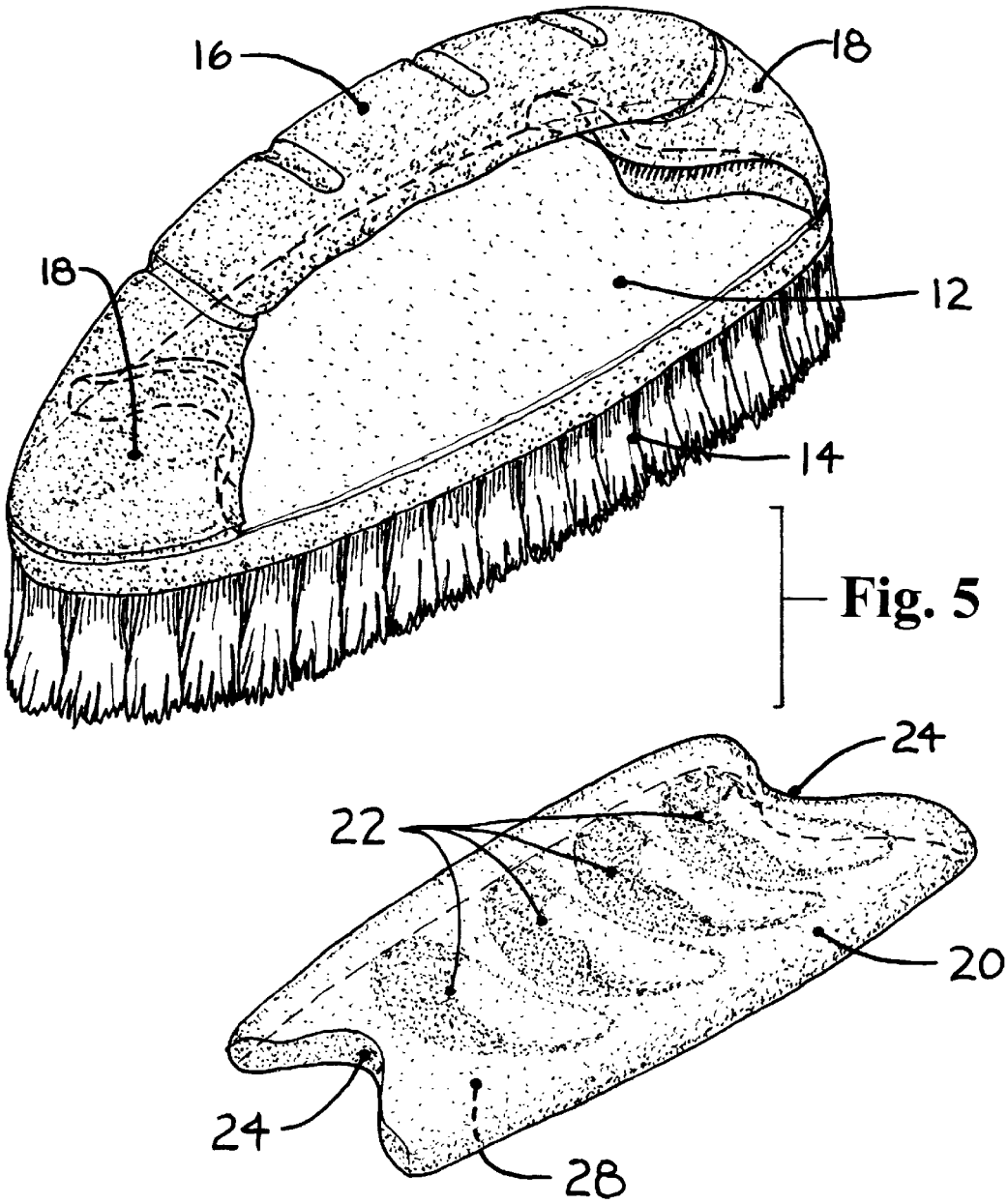
FIG. 5 is a perspective exploded view of the scrub brush showing the knuckle pad in the form of an insert.

As illustrated in FIG. 3, the knuckle pad 20 includes opposed end portions and formed in the opposed end portions is a pair of cutouts or indentions 24. The cutouts or indentions 24 are particularly configured to extend at least partially around the base portions of the handle supports 18. That is, the cutouts or indentions 24 are designed to extend around the handle supports 18 adjacent the area where the handle supports 18 join or meet the bristle block 12.

The knuckle pad 20 can be secured by glue or other suitable means directly to the upper surface of the bristle block 12. In the alternative, the knuckle pad 20 can be in the form of an insert which means that the knuckle pad 20 can be readily inserted into the scrub brush and removed therefrom. FIG. 3 shows the knuckle pad 20 in the form of an insert pad. Note that the cutouts or indentions 24 are adapted to extend around portions of the handle supports 18 when the knuckle pad 20 is inserted onto the upper surface of the bristle block 12. When inserted onto the bristle block 12, it is seen that the cutouts or indentions 24 extending around the base of the handle supports 18 results in the insert knuckle pad 20 being firmly and securely retained within the scrub brush 10 without the need for mechanical fasteners or other securing means. The general pliable or flexible nature of the insert knuckle pad 20 shown in FIG. 3 enables the same to be easily removed from the scrub brush 10.

Further, the knuckle pad 20 when in the form of an insert can also function as a sponge or scrub/scouring pad. In particular, the insert 20 may include a scouring surface 28 formed about the underside of the insert. Thus, the insert knuckle pad 20 can be removed from the scrub brush 10 and simply used alone as a sponge, scouring pad, or other cleaning device.

In use, the upper surface of the knuckle pad 20 is spaced downwardly from the handle 16. It is appreciated, that once a user's hand is placed around the handle 16 that the knuckles and adjacent portions of the user's fingers will generally lie below the top portion of the handle 16 and will generally be disposed adjacent the knuckle pad 20. The handle 16 is spaced relative to the knuckle pad 20 such that when the user's hand is wrapped around the handle 16 the knuckles and adjacent finger portions of the hand will engage and rest on the knuckle pad 20. Knuckle and knuckle areas are terms used herein to describe portions of the user's hand that engage or rest upon the knuckle pad 20. As used, the term knuckles and knuckle areas are each intended to mean and to embrace portions of the finger that are around the handle of the scrub brush. Besides providing for protection for the knuckles and finger portions, the configuration and layout of the handle and knuckle pad 20 enable the scrub brush 10 to take advantage of the forces associates with parts of the hand other than the palm. In this design, with the knuckles and adjacent finger portions bearing down on the knuckle pad 20 it is appreciated that these forces tend to increase the total force being applied to the scrub brush 10 and to the area being cleaned. Specifically, the design allows the user to apply downward, lateral and longitudinal pressure with the knuckles and backs of the fingers that engage and press upon the knuckle pad 20. Although the force attributable to the knuckles and the finger portions may not be as great as the force applied to the handle, it nevertheless increases the total force applied and can reduce overall hand and finger fatigue. The shape of the knuckle pad 20 and the depressions formed therein aid in transferring the lateral and longitudinal forces being applied through the knuckles and finger portions of the user's hand. Further, the knuckle pad 20 assists in disbursing point load pressure encountered by the user during cleaning when the scrub brush 10 itself tends to "kick back." This problem occurs when the scrub brush 10 encounters obstacles or deviations in the surfaces being cleaned. The design of the scrub brush as a whole and particularly the placement and orientation of the knuckle pad 20, serves to protect the knuckles and finger portions of the user's hand and generally prevents these portions of the hands from being cut, scraped or bruised. It is appreciated that the bristle block, handle, and handle supports of the scrub brush 10 can be constructed of various materials, such as plastic, wood, metal, or other suitable materials.

From the foregoing specification and discussion, it is appreciated that the scrub brush 10 of the present invention by incorporating the knuckle pad 20 will protect the knuckle area of a user's hand and will generally prevent the knuckles and the adjacent finger portions from being skinned and cut due to the hand slipping off the handle 16 during a scrubbing or cleaning exercise.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A scrub brush having a knuckle pad comprising:

a. a bristle block having upper and lower surfaces;

b. an array of bristles extending from the lower surface of the bristle block;

c. a handle disposed over the bristle block; and d. a knuckle pad spaced below the handle for engaging and protecting a knuckle portion of a user's hand gripped around the handle, the knuckle pad including a foam pad having a top surface and a series of spaced apart impressions formed in the top surface.

2. The scrub brush of claim 1 wherein the foam knuckle pad is compressible.

3. A scrub brush having a knuckle pad comprising:

a) a bristle block having upper and lower surfaces;

b) an array of bristles extending from the lower surface of the bristle block;

c) a handle support fixed to and upwardly extending from an end portion of said bristle block and a handle connected to said handle support and extending along the length of the bristle block, a lower surface of the handle being spaced from the upper surface of the bristle block; and d) a flexible knuckle pad made of a compressible material covering a portion of the upper surface of the bristle block underneath said handle wherein an upper surface of the knuckle pad and the lower surface of the handle are particularly spaced relative to each other such that the knuckle portion of the user's hand projects downward into engagement with the knuckle pad such that during a scrubbing operation the knuckle pad protects the knuckle portion of the user's hand.

4. The scrub brush of claim 3 wherein the knuckle pad includes a foam pad.

5. The scrub brush of claim 4 wherein the foam knuckle pad includes a top surface and a series of spaced apart impressions formed in the top surface of the knuckle pad.

6. The scrub brush of claim 3 wherein the knuckle pad assumes the form of an insert that can be readily inserted into and removed from the scrub brush.

7. The scrub brush of claims 6 wherein the handle is supported by a pair of spaced apart handle supports and wherein the insert knuckle pad is adapted to be inserted between the handle supports.

8. The scrub brush of claim 3 wherein the knuckle pad is disposed on and supported by the bristle block.

9. The scrub brush of claim 3 wherein the knuckle pad includes a top surface that has formed therein a series of spaced apart impressions.

10. The scrub brush of claim 3 wherein the handle is spaced above the knuckle pad such that when the user's hand wraps around the handle, portions of the user's hand engage and rests on the underlying knuckle pad.

* * * * *